US010701763B2

(12) United States Patent
Huang

(10) Patent No.: US 10,701,763 B2
(45) Date of Patent: Jun. 30, 2020

(54) THICK FILM ELEMENT WITH HIGH HEAT CONDUCTIVITY ON TWO SIDES THEREOF

(71) Applicant: GUANGDONG FLEXWARM ADVANCED MATERIALS & TECHNOLOGY CO., LTD., Guangzhou, Guangdong (CN)

(72) Inventor: Weicong Huang, Guangdong (CN)

(73) Assignee: GUANGDONG FLEXWARM ADVANCED MATERIALS & TECHNOLOGY CO., LTD., Guangzhou, Guangdong (CN)

( * ) Notice: Subject to any disclaimer, the term of this patent is extended or adjusted under 35 U.S.C. 154(b) by 12 days.

(21) Appl. No.: 15/534,489

(22) PCT Filed: Mar. 26, 2016

(86) PCT No.: PCT/CN2016/077443

§ 371 (c)(1),
(2) Date: Jun. 9, 2017

(87) PCT Pub. No.: WO2017/117873

PCT Pub. Date: Jul. 13, 2017

(65) Prior Publication Data

US 2018/0317283 A1 Nov. 1, 2018

(30) Foreign Application Priority Data

Jan. 6, 2016 (CN) ..... 2016 1 0013179

(51) Int. Cl.

| | |
|---|---|
| ***H05B 3/26*** | (2006.01) |
| ***H05B 3/12*** | (2006.01) |
| ***H05B 3/16*** | (2006.01) |
| ***H05B 3/06*** | (2006.01) |

(52) U.S. Cl.

CPC ..... *H05B 3/265* (2013.01); *H05B 3/06* (2013.01); *H05B 3/12* (2013.01); *H05B 3/16* (2013.01); *H05B 3/267* (2013.01); *H05B 2203/013* (2013.01)

(58) Field of Classification Search

CPC ..... H05B 3/262; H05B 3/748; H05B 3/82; H05B 3/12; H05B 3/02; H05B 3/22; H05B 3/34; H05B 3/26; H05B 3/265; H05B 3/267; H05B 3/28; H05B 3/06; H05B 3/16; H05B 3/18; H05B 3/286; H05B 3/283; H05B 3/36; H05B 2203/013; H05B 2203/017; H05B 2203/037; H05B 2203/01

See application file for complete search history.

(56) References Cited

U.S. PATENT DOCUMENTS

2004/0238525 A1 12/2004 Wermbter et al.

FOREIGN PATENT DOCUMENTS

| | | |
|---|---|---|
| CN | 2204475 | 8/1995 |
| CN | 1494815 | 5/2004 |
| CN | 101778501 | 7/2010 |
| CN | 102833894 | 12/2012 |
| WO | 2011047471 | 4/2011 |

*Primary Examiner* — Shawntina T Fuqua

(57) ABSTRACT

The present invention provides a thick film element with high heat conductivity on two sides thereof, which comprises a carrier, a thick film coating deposited on the carrier, and a covering layer overlays on the coating; the thick film coating is heating materials, and mode of heating is electrical heating, wherein the carrier, the thick film coating and the covering layer are selected from the material that fulfill every following equations: $Q_2 \geq Q_3$; $Q_2 \geq Q_1$; and $Q_1 = a \times Q_3$, $Q_2 = b \times Q_1$, $Q_2 = c \times Q_3$; and $0.1 \leq a \leq 150$, $1 \leq b \leq 2500$, $100 \leq c \leq 10000$. The thick film element of the present invention has high heat conductivity and uniform heat generating rate on both sides thereof, thus improving heat transfer efficiency of the product; it could be applied in products that require double-sided high heat conductivity, meeting the market demand for multifunctional heating products.

14 Claims, No Drawings

THICK FILM ELEMENT WITH HIGH HEAT CONDUCTIVITY ON TWO SIDES THEREOF

FIELD OF THE INVENTION

The present invention relates to the field of thick film, and more particularly to a thick film element with high heat conductivity on two sides thereof.

BACKGROUND OF THE INVENTION

Thick film heating elements refer to heating elements that are made by fabricating exothermic materials on a substrate thick films and providing electricity to generate heat. The conventional heating methods include electrical heating tube heating and PTC heating. An electrical heated tube heating element uses a metal tube as the outer case and distributes spirally nickel-chromium or iron-chromium alloy spirally therein to form heater strips; the clearance space is then filled with magnesite clinker that has excellent thermal conductivity and insulativity and sealed with silica gel from two ends of the tube. The PTC heating method uses ceramics as the exothermic material. Both electrical heated tube heating and PTC heating conduct heating indirectly with low thermal efficiency, and are structurally huge and bulky. Besides, in consideration of environmental protection, heaters using these two types of heating methods stain easily after repeatedly heating and cleaning thereof is not easy. Additionally, PTC heaters contain lead and other hazardous substances and are easily oxidized, causing power attenuation and short service life.

Chinese application CN201210320614.9 discloses an aluminum alloy heating tube using thick film heating, which comprises a heating tube body and a thick film heating plate. An insertion slot, the depth direction of which extends radially inward, is disposed at a side of the heating tube body. The thick film heating plate is positioned in the insertion slot. The heating tube body has through-holes, the length direction of which exten axially inward along the heating tube body, disposed on two sides of the insertion slot. In the aluminum alloy heating tube, the thick film heating circuit on the thick film circuit board is printed on the ceramics substrate or a substrate of other insulating material. In addition, the thick film circuit board is coated with one more layer of insulating medium; therefore, the surface of the entire thick film circuit board is insulative.

Chinese application CN201010110037.1 discloses a thick film heating assembly with dry burning protection function, which comprises a thick film heater for electrical heating, an electrical connection bracket mounted on the thick film heater for connecting the thick film heater with external components, and a dry-burning protector mounted on the thick film heater. The electrical connection bracket and the dry-burning protector form the whole components, and the dry-burning protector contains at least one electrical dry-burning-proof protector electrically connected to the control circuit and one mechanical dry-burning-proof protector.

Although the existing heating elements have gradually been applied to the field of household electrical appliances, the heating bodies of the thick film element mentioned above are attached onto the electrical appliances, and few independent components are existed at present. Up to date, none of the existing heating elements has double-sided high heat conductivity, and no double-sided heating thick film element has been applied to daily living and industrial production to realize the function of uniform heating on both sides of the element.

SUMMARY OF THE INVENTION

To solve these problems mentioned above, the present invention provides a thick film element with high heat conductivity on two sides thereof with the advantages of small volume, high efficiency, environmental-friendly, high safety performance and long service lifespan.

The concept of thick film in the present invention is a term comparative to thin films. Thick film is a film layer with a thickness ranging from several microns to tens of microns formed by printing and sintering on a carrier; the material used to manufacture the film layer is known as thick film material, and the coating made from the thick film is called thick film coating. The thick film element has the advantages of high power density, fast heating speed, high working temperature, fast heat generating rate, high mechanical strength, small volume, easy installation, uniform heating temperature field, long lifespan, energy saving and environmental friendly, and excellent safety performance.

The thick film element with high heat conductivity on two sides thereof of the present invention, comprises a carrier, a thick film coating deposited on the carrier, and a covering layer overlaid on the coating. The thick film coating is a heating material, and the mode of heating is electrical heating. The carrier, the thick film coating and the covering layer are selected from a material that fulfills every of the following equations:

$$Q_2 \geq Q_3;$$

$$Q_2 \geq Q_1;$$

$$\text{and } Q_1 = a \times Q_3,\ Q_2 = b \times Q_1,\ Q_2 = c \times Q_3;$$

$$\text{and } 0.1 \leq a \leq 150,\ 1 \leq b \leq 2500,\ 100 \leq c \leq 10000;$$

wherein the calculation formula for $Q_1$:

$$Q_1 = \lambda_1 A \frac{T_1 - T_0}{b_1},$$

the calculation formula for $Q_2$:

$$Q_2 = \lambda_2 A \frac{T_2 - T_0}{b_2},$$

the calculation formula for $Q_3$:

$$Q_3 = \lambda_3 A \frac{T_3 - T_0}{b_3},$$

$$T_2 < T_{\text{Minimum melting point of the covering layer}};$$

$$T_2 < T_{\text{Minimum melting point of the carrier}};$$

$$T_0 \leq 25^\circ \text{ C.};$$

wherein $Q_1$ represents the heat transfer rate of the covering layer; $Q_2$ represents the heat generating rate of the thick film coating; $Q_3$ represents the heat transfer rate of the carrier;

$\lambda_1$ represents the heat conductivity coefficient of the covering layer; $\lambda_2$ represents the heat conductivity coefficient of the thick film coating; $\lambda_3$ represents the heat conductivity coefficient of the carrier;

A represents the contact area of the thick film coating with the covering layer or the carrier;

$b_1$ represents the thickness of the covering layer; $b_2$ represents the thickness of the thick film coating; $b_3$ represents the thickness of the carrier;

$T_0$ represents the initial temperature of the thick film element; $T_1$ represents the surface temperature of the covering layer; $T_2$ represents the heating temperature of the thick film coating; $T_3$ represents the surface temperature of the carrier;

$$b_2 \leq 50\ \mu m;$$

$$b_3 \geq b_1,\ b_1 \leq 1\ mm,\ b_3 \geq 1\ mm;$$

$$T_{Minimum\ melting\ point\ of\ the\ carrier} > 25°\ C.$$

The covering layer is a dielectric layer coating on the thick film coating by printing or sintering, and the area of the covering layer is larger than that of the thick film coating.

The carrier is the dielectric layer carrying the thick film coating. The thick film coating covers the carrier by printing or sintering.

The heat conductivity coefficient refers to the heat transferred by a one-meter thick material having a temperature difference between two side surfaces of 1 degree (K, ° C.), through one square meter (1 $m^2$) area within one second (1 S) under a stable heat transfer condition. Unit of the heat conductivity coefficient is watt/meter·degree (W/(m·K), and K may be replaced by ° C.).

The covering layer, the thick film coating and carrier sticks closely with each other at the electrical heating parts of the thick film elements, and both ends of the thick film coating connect to external electrodes. When given electricity, the thick film coating is heated and becomes hot after electricity energy is transformed to thermal energy. Heat generating rate of the thick film coating could be calculated by $$Q_2 = \lambda_2 A \frac{T_2 - T_0}{b_2}$$

according to the heat conductivity coefficient, contact area, initial temperature, heating temperature and thickness of the thick film coating, wherein $T_2$ represents the heating temperature of the thick film.

The present invention features in that both sides of the thick film element have high heat conductivity, and that the heat generating rate of the covering layer, the thick film coating and the carrier should meet the following requirements:

(1) The heat transfer rate of the covering layer and the thick film coating should satisfy the following formula: $Q_1 = a \times Q_3$, wherein $0.1 \leq a \leq 150$; for those thick film elements satisfied the above equation, the covering layer and the carrier of the thick film element have a uniform heat transfer ability, thus avoiding overly fast temperature raising on one side and overly slow temperature raising on the other side of the thick film element and avoiding the phenomenon of uneven heating on the two sides, which would not meet the technical effect of the present invention;

(2) The heat generating rate of the thick film coating and the heat transfer rate of the covering layer should satisfy the following formula: $Q_2 \geq Q_1$, and $Q_2 = b \times Q_1$, wherein $1 \leq b \leq 2500$; if the heat generating rate of the thick film coating is much larger than the heat transfer rate of the covering layer, the continuously accumulated heat of the thick film coating could not be conducted away, such that the temperature of the thick film coating keeps rising, and when the temperature is higher than the minimum melting point of the covering layer, the covering layer would begin to melt or even burn, which would destroy the structure of the covering layer or the carrier, thus destroying the thick film elements.

(3) The heat generating rate of the thick film coating and the heat transfer rate of the carrier should satisfy the following formula: $Q_2 \geq Q_3$, and $Q_2 = c \times Q_3$, $100 \leq c \leq 10000$; if the heat generating rate of the thick film coating is much larger than the heat transfer rate of the carrier, the continuously accumulated heat of the thick film coating could not be conducted away, such that the temperature of the thick film coating keeps rising, and when the temperature is higher than the minimum melting point of the carrier, the carrier would begin to melt or even burn, which would destroy the structure of the carrier, thus destroying the thick film elements.

(4) The heating temperature of the thick film coating could not be higher than the minimum melting point of the covering layer or the carrier, and should meet the requirements: $T_2 < T_{Minimum\ melting\ point\ of\ the\ covering\ layer}$ and $T_2 < T_{Minimum\ melting\ point\ of\ the\ carrier}$. Excessively high heating temperature should be avoided to prevent destruction of the thick film elements.

When the above-mentioned requirements are met, the heat transfer rates of the covering layer and the carrier are determined by the properties of the material and the thick film element. The formula for calculating the heat transfer rate of the covering layer is $$Q_1 = \lambda_1 A \frac{T_1 - T_0}{b_1},$$

wherein $\lambda_1$ represents heat conductivity coefficient of the covering layer, with the unit being W/m·k, and is determined by properties of the materials for preparing the covering layer; $b_1$ represents the thickness of the covering layer, and is determined by the preparation technique and the requirements of the thick film elements; $T_1$ represents the surface temperature of the covering layer, and is determined by properties of the thick film elements.

The formula for calculating the heat transfer rate of the carrier is $$Q_3 = \lambda_3 A \frac{T_3 - T_0}{b_3},$$

wherein $\lambda_3$ represents the heat conductivity coefficient of the carrier, with the unit being W/m·k, and is determined by properties of the materials for preparing the carrier; $d_3$ represents the thickness of the carrier, and is determined by the preparation technique and the requirements of the thick film elements; $T_3$ represents the surface temperature of the carrier, and is determined by properties of the thick film elements.

Preferably, the carrier and the thick film coating are bound by printing or sintering, the thick film coating and the covering layer are bound by printing or sintering.

Preferably, the region between the carrier and the covering layer without the thick film coating is bound by printing or sintering.

Preferably, the carrier includes polyimides, organic insulating materials, inorganic insulating materials, ceramics, glass ceramics, quartz, crystal and stone materials.

Preferably, the thick film coating is one or more of silver, platinum, palladium, palladium oxide, gold or rare earth materials.

Preferably, the covering layer is made from one or more of polyester, polyimide or polyetherimide (PEI), ceramics, silica gel, asbestos, micarex.

Preferably, the area of the thick film coating is smaller than or equal to that of the covering layer or the carrier.

The present invention also provides a use of the thick film elements for products with double-sided heating.

The beneficial effects of the present invention are as follows:

(1) The thick film element of the present invention has high heat conductivity and uniform heat generating rate on two sides thereof, and shows improved heat transfer efficiency.

(2) The three-layered structure of the thick film element of the present invention could be bound directly by printing or sintering, and the thick film coating would heat the covering layer directly so as to improve the heat conduction efficiency. Additionally, the covering layer of the present invention covers the thick film coating, thus avoiding the problem of electric leakage when the thick film coating is given electricity and improving safety performance.

(3) The thick film element of the present invention could be applied in products that require high heat conductivity on both sides, meeting the market demand for multifunctional heating products.

(4) The thick film element of the present invention generates heat by the thick film coating. The thickness of the thick film coating is at the micrometer level, thus generating heat evenly after given electricity. The thick film element has a long service lifespan.

DETAILED DESCRIPTION OF PREFERRED EMBODIMENTS

The present invention will now be described more specifically with reference to the following embodiments. It is to be noted that the following descriptions of preferred embodiments of this invention are presented herein for purpose of illustration and description only. It is not intended to be exhaustive or to be limited to the precise form disclosed.

The present invention discloses a thick film element with high heat conductivity on two sides thereof of the present invention, comprises a carrier, a thick film coating deposited on the carrier, and a covering layer overlaid on the coating. The thick film coating is a heating material, and the mode of heating is electrical heating. The carrier, the thick film coating and the covering layer are selected from a material that fulfills every of the following equations:

$$Q_2 \geq Q_3;$$

$$Q_2 \geq Q_1;$$

$$\text{and } Q_1 = a \times Q_3,\ Q_2 = b \times Q_1,\ Q_2 = c \times Q_3;$$

$$\text{and } 0.1 \leq a \leq 150,\ 1 \leq b \leq 2500,\ 100 \leq c \leq 10000;$$

wherein, the calculation formula for $Q_1$:

$$Q_1 = \lambda_1 A \frac{T_1 - T_0}{b_1},$$

the calculation formula for $Q_2$:

$$Q_2 = \lambda_2 A \frac{T_2 - T_0}{b_2},$$

the calculation formula for $Q_3$:

$$Q_3 = \lambda_3 A \frac{T_3 - T_0}{b_3},$$

$$T_2 < T_{Minimum\ melting\ point\ of\ the\ covering\ layer};$$

$$T_2 < T_{Minimum\ melting\ point\ of\ the\ carrier};$$

$$T_0 \leq 25^\circ\ \text{C.};$$

$b_2$ represents the thickness of the thick film coating, $b_2 \leq 50$ μm;

$b_1$ represents the thickness of the covering layer; $b_3$ represents the thickness of the carrier, $b_3 \geq b_1$, $b_1 \leq 1$ mm, $b_3 \geq 1$ mm;

$$T_{Minimum\ melting\ point\ of\ the\ carrier} > 25^\circ\ \text{C.}$$

The following embodiments include 20 thick film elements prepared by the inventors, and the materials for preparing the covering layer, the thick film coating and the carrier of the 20 listed thick film elements all satisfy the above equations above. The detailed preparing method and formula are provided as follows:

Embodiments

Silver paste with a heat conductivity coefficient of $\lambda_2$ is selected to prepare the thick film coating, polyimides with a heat conductivity coefficient of $\lambda_3$ is selected to prepare the carrier, and polyimides with a heat conductivity coefficient of $\lambda_1$ is selected to prepare the covering layer. The three layers are bound by sintering. The area of the prepared thick film coating is $A_2$, the thickness is $b_2$; the area of the covering layer is $A_1$, the thickness is $b_1$; the area of the carrier is $A_3$, the thickness is $b_3$.

Turn on an external DC power supply to charge the thick film coating. The thick film starts to heat up; when the heating is stabled, measure the surface temperature of the covering layer and the carrier, and the heating temperature of the thick film coating under a stable heating state is measured. Heat transfer rate of the covering layer and the carrier, and heat generating rate of the thick film coating are calculated according to the following formula:

$$Q_1 = \lambda_1 A \frac{T_1 - T_0}{b_1},$$

$$Q_2 = \lambda_2 A \frac{T_2 - T_0}{b_2},$$

$$Q_3 = \lambda_3 A \frac{T_3 - T_0}{b_3}.$$

Tables 1 to 4 are the 20 thick film elements prepared by the inventors. After provided electricity to heat for 2 minutes, the thick film elements are measured according to the national standards to obtain the performance data (heat conductivity coefficient, surface temperature) as shown in the Tables. The thickness, contact area, initial temperature are measured before heating.

Table 1 is the performance data of the covering layers of the thick film elements in Embodiments 1 to 20. The details are as follows:

TABLE 1

| | Covering Layer | | | | |
|---|---|---|---|---|---|
| | Heat Conductivity Coefficient $\lambda_1$ (W/m · k) | Thickness $b_1$ (μm) | Surface Temperature $T_1$ (° C.) | $T_{Minimum\ melting\ point\ of\ the\ covering\ layer}$ (° C.) | Initial Temperature $T_0$ (° C.) |
| Embodiment 1 | 7.2 | 25 | 113 | 350 | 25 |
| Embodiment 2 | 7.2 | 25 | 55 | 350 | 25 |
| Embodiment 3 | 7.2 | 25 | 102 | 350 | 25 |
| Embodiment 4 | 7.2 | 50 | 53 | 350 | 25 |
| Embodiment 5 | 7.2 | 50 | 97 | 350 | 25 |
| Embodiment 6 | 7.2 | 75 | 51 | 350 | 25 |
| Embodiment 7 | 7.2 | 75 | 94 | 350 | 25 |
| Embodiment 8 | 7.2 | 75 | 47 | 350 | 25 |
| Embodiment 9 | 7.2 | 100 | 93 | 350 | 25 |
| Embodiment 10 | 7.2 | 100 | 44 | 350 | 25 |
| Embodiment 11 | 7.2 | 200 | 48 | 350 | 25 |
| Embodiment 12 | 7.2 | 200 | 93 | 350 | 25 |
| Embodiment 13 | 7.2 | 300 | 91 | 350 | 25 |
| Embodiment 14 | 7.2 | 300 | 44 | 350 | 25 |
| Embodiment 15 | 7.2 | 400 | 96 | 350 | 25 |
| Embodiment 16 | 7.2 | 400 | 44 | 350 | 25 |
| Embodiment 17 | 7.2 | 500 | 101 | 350 | 25 |
| Embodiment 18 | 7.2 | 500 | 47 | 350 | 25 |
| Embodiment 19 | 7.2 | 600 | 92 | 350 | 25 |
| Embodiment 20 | 7.2 | 600 | 30 | 350 | 25 |

Table 2 is the performance data of the thick film coatings of the thick film elements in Embodiments 1 to 20. The details are as follows:

TABLE 2

| | Thick Film Coating | | | | |
|---|---|---|---|---|---|
| | Heat Conductivity Coefficient $\lambda_2$ (W/m · k) | Thickness $b_2$ (μm) | Area $A_2$ ($m^2$) | Heating temperature $T_2$ (° C.) | Initial temperature $T_0$ (° C.) |
| Embodiment 1 | 382 | 50 | 0.016 | 116 | 25 |
| Embodiment 2 | 382 | 50 | 0.056 | 56 | 25 |
| Embodiment 3 | 382 | 40 | 0.016 | 103 | 25 |
| Embodiment 4 | 382 | 40 | 0.056 | 54 | 25 |
| Embodiment 5 | 382 | 30 | 0.016 | 98 | 25 |
| Embodiment 6 | 382 | 30 | 0.056 | 52 | 25 |
| Embodiment 7 | 382 | 30 | 0.016 | 95 | 25 |
| Embodiment 8 | 382 | 25 | 0.056 | 51 | 25 |
| Embodiment 9 | 382 | 25 | 0.016 | 97 | 25 |
| Embodiment 10 | 382 | 25 | 0.056 | 46 | 25 |
| Embodiment 11 | 382 | 30 | 0.016 | 49 | 25 |
| Embodiment 12 | 382 | 30 | 0.056 | 95 | 25 |
| Embodiment 13 | 382 | 20 | 0.016 | 95 | 25 |
| Embodiment 14 | 382 | 20 | 0.056 | 45 | 25 |
| Embodiment 15 | 382 | 30 | 0.016 | 99 | 25 |
| Embodiment 16 | 382 | 30 | 0.056 | 46 | 25 |
| Embodiment 17 | 382 | 35 | 0.016 | 103 | 25 |
| Embodiment 18 | 382 | 35 | 0.056 | 49 | 25 |
| Embodiment 19 | 382 | 25 | 0.016 | 94 | 25 |
| Embodiment 20 | 382 | 25 | 0.056 | 36 | 25 |

Table 3 is the performance data of the carriers of the thick film elements in Embodiments 1 to 20. The details are as follows:

TABLE 3

| | Carrier | | | | |
|---|---|---|---|---|---|
| | Heat Conductivity Coefficient $\lambda_3$ (W/m · k) | Thickness $b_3$ (μm) | Surface Temperature $T_3$ (° C.) | $T_{Minimum\ melting\ point\ of\ the\ carrier}$ (° C.) | Initial Temperature $T_0$ (° C.) |
| Embodiment 1 | 7.2 | 1 | 105 | 350 | 25 |
| Embodiment2 | 7.2 | 2 | 42 | 350 | 25 |
| Embodiment 3 | 7.2 | 3 | 87 | 350 | 25 |
| Embodiment4 | 7.2 | 1 | 43 | 350 | 25 |
| Embodiment 5 | 7.2 | 2 | 86 | 350 | 25 |
| Embodiment 6 | 7.2 | 1 | 40 | 350 | 25 |
| Embodiment 7 | 7.2 | 2 | 84 | 350 | 25 |
| Embodiment 8 | 7.2 | 3 | 38 | 350 | 25 |
| Embodiment 9 | 7.2 | 1 | 87 | 350 | 25 |
| Embodiment 10 | 7.2 | 2 | 40 | 350 | 25 |
| Embodiment 11 | 7.2 | 3 | 38 | 350 | 25 |
| Embodiment 12 | 7.2 | 4 | 78 | 350 | 25 |
| Embodiment 13 | 7.2 | 1 | 85 | 350 | 25 |
| Embodiment 14 | 7.2 | 2 | 39 | 350 | 25 |
| Embodiment 15 | 7.2 | 3 | 85 | 350 | 25 |
| Embodiment 16 | 7.2 | 4 | 34 | 350 | 25 |
| Embodiment 17 | 7.2 | 3 | 87 | 350 | 25 |
| Embodiment 18 | 7.2 | 4 | 31 | 350 | 25 |
| Embodiment 19 | 7.2 | 1 | 91 | 350 | 25 |
| Embodiment 20 | 7.2 | 2 | 36 | 350 | 25 |

Table 4 is the heat transfer rate calculated according to the performance data listed in Tables 1, 2 and 3. The heat transfer rates of the covering layer, the thick film coating and the carrier are calculated by ratio to obtain the limiting conditions of the materials of the present invention, namely the following equations:

$Q_2 \geq Q_3$; $Q_2 \geq Q_1$; and $Q_1 = a \times Q_3$, $Q_2 = b \times Q_1$, $Q_2 = c \times Q_3$;
wherein $0.1 \leq a \leq 150$, $1 \leq b \leq 2500$, $100 \leq c \leq 10000$.

TABLE 4

| | Covering Layer Heat Transfer Rate $Q_1$ | Thick Film Coating Heat Generating Rate $Q_2$ | Carrier Heat Transfer Rate $Q_3$ | $Q_2/Q_1$ | $Q_2/Q_3$ | $Q_1/Q_3$ | Satisfy the equations? |
|---|---|---|---|---|---|---|---|
| Embodiment 1 | 419328 | 11123840 | 10483.2 | 26.5278 | 1061 | 40 | Yes |
| Embodiment 2 | 467712 | 13263040 | 5846.4 | 28.3573 | 2269 | 80 | Yes |
| Embodiment 3 | 359424 | 11918400 | 2995.2 | 33.1597 | 3979 | 120 | Yes |
| Embodiment 4 | 217728 | 16044000 | 10886.4 | 73.6883 | 1474 | 20 | Yes |
| Embodiment 5 | 163584 | 14872533 | 4089.6 | 90.9168 | 3637 | 40 | Yes |
| Embodiment 6 | 145152 | 19252800 | 10886.4 | 132.639 | 1769 | 13.333 | Yes |
| Embodiment 7 | 107520 | 1421333.3 | 4032 | 13.2192 | 352.5 | 26.667 | Yes |
| Embodiment 8 | 96768 | 22247680 | 2419.2 | 229.907 | 9196 | 40 | Yes |
| Embodiment 9 | 82944 | 17602560 | 8294.4 | 212.222 | 2122 | 10 | Yes |
| Embodiment 10 | 84672 | 17969280 | 4233.6 | 212.222 | 4244 | 20 | Yes |
| Embodiment 11 | 13824 | 4889600 | 921.6 | 353.704 | 5306 | 15 | Yes |
| Embodiment 12 | 141120 | 49914667 | 7056 | 353.704 | 7074 | 20 | Yes |
| Embodiment 13 | 26880 | 21392000 | 8064 | 795.833 | 2653 | 3.3333 | Yes |
| Embodiment 14 | 26880 | 21392000 | 4032 | 795.833 | 5306 | 6.6667 | Yes |
| Embodiment 15 | 21312 | 15076267 | 2841.6 | 707.407 | 5306 | 7.5 | Yes |
| Embodiment 16 | 17136 | 14974400 | 1713.6 | 873.856 | 8739 | 10 | Yes |
| Embodiment 17 | 17971.2 | 13621029 | 2995.2 | 757.937 | 4548 | 6 | Yes |
| Embodiment 18 | 19353.6 | 14668800 | 2419.2 | 757.937 | 6063 | 8 | Yes |
| Embodiment 19 | 13248 | 16869120 | 7948.8 | 1273.33 | 2122 | 1.6667 | Yes |
| Embodiment 20 | 4032 | 9412480 | 4435.2 | 2334.44 | 2122 | 0.9091 | Yes |

The results listed in Table 4 shows that the thick films prepared according to Embodiments 1 to 20 all satisfy the equations; both sides of the thick film generate heat evenly, and the temperature difference between the two sides is smaller than 16° C. The thick film element could rise to more than 100° C. after given electricity for 2 minutes, demonstrating that thick film element of the present invention has high heat generating efficiency.

Tables 5 to 8 are the performance data of the thick film elements in Contrasting Examples 1 to 3 of the present invention. All the performance data is measured as those shown in Tables 1 to 4. The details are as follows:

TABLE 5

| | Covering Layer | | | | |
|---|---|---|---|---|---|
| | Heat Conductivity Coefficient $\lambda_1$ (W/m · k) | Thickness $b_1$ (μm) | Surface Temperature $T_1$ (° C.) | $T_{Minimum\ melting\ point\ of\ the\ covering\ layer}$ (° C.) | Initial Temperature $T_0$ (° C.) |
| Contrasting Example 1 | 7.2 | 25 | 102 | 350 | 25 |
| Contrasting Example 2 | 7.2 | 50 | 97 | 350 | 25 |
| Contrasting Example 3 | 7.2 | 75 | 94 | 350 | 25 |

TABLE 6

| | Thick Film Coating | | | | |
|---|---|---|---|---|---|
| | Heat Conductivity Coefficient $\lambda_2$ (W/m · k) | Thickness $b_2$ (μm) | Area $A_2$ ($m^2$) | Heating Temperature $T_2$ (° C.) | Initial Temperature $T_0$ (° C.) |
| Contrasting Example 1 | 382 | 40 | 0.016 | 103 | 25 |
| Contrasting Example 2 | 382 | 30 | 0.016 | 96 | 25 |
| Contrasting Example 3 | 382 | 30 | 0.016 | 95 | 25 |

TABLE 7

| | Carrier | | | | |
|---|---|---|---|---|---|
| | Heat Conductivity Coefficient $\lambda_3$ (W/m · k) | Thickness $b_3$ (μm) | Surface Temperature $T_3$ (° C.) | $T_{Minimum\ melting\ point\ of\ the\ carrier}$ (° C.) | Initial Temperature $T_0$ (° C.) |
| Contrasting Example 1 | 7.2 | 3 | 56 | 350 | 25 |
| Contrasting Example 2 | 2.7 | 2 | 55 | 350 | 25 |
| Contrasting Example 3 | 3.5 | 2 | 48 | 350 | 25 |

TABLE 8

| | $Q_1$ | $Q_2$ | $Q_3$ | $Q_2/Q_1$ | $Q_2/Q_3$ | $Q_1/Q_3$ | Satisfy the equations? |
|---|---|---|---|---|---|---|---|
| Contrasting Example 1 | 359424 | 11918400 | 1190.4 | 33.1 | 10012.09 | 301 | No |
| Contrasting Example 2 | 163584 | 14872533 | 648 | 90.9 | 22951.44 | 252 | No |
| Contrasting Example 3 | 107520 | 1421333.3 | 644 | 13 | 2207.03 | 166 | No |

Material and structure of the thick film elements in the Contrasting Examples 1 to 3 listed in the above tables neither meet the material selection requirement of the present invention nor satisfy the equations of the present invention. After given electricity and heat generation, both sides of the thick film could not generate heat evenly, and the temperature difference between the two sides is more than 40° C. It is the result of overly fast temperature rising of the covering layer and overly slow temperature rising of the carrier, which do not meet the requirement of the thick film element with high heat conductivity on both sides thereof of the present invention or meet the product requirement of the present invention, which demonstrates the heat transfer rate and correlation of the present invention According to the disclosure and teaching of above-mentioned specification, those skilled in the art of the present invention can still make changes and modifications to above-mentioned embodiment, therefore, the scope of the present invention is not limited to the specific embodiments disclosed and described above, and all those modifications and changes to the present invention are within the scope of the present invention as defined in the appended claims. Besides, although some specific terminologies are used in the specification, it is merely as a clarifying example and shall not be constructed as limiting the scope of the present invention in any way.

What is claimed is:

1. A thick film element with high heat conductivity on two sides thereof, comprising: a carrier; a thick film coating deposited on the carrier; and a covering layer overlaid on the coating, wherein the thick film coating is a heating material, and a mode of heating is electrical heating, wherein the carrier, the thick film coating and the covering layer are selected from a material that fulfills every of following equations:

$$Q_2 \geq Q_3;$$

$$Q_2 \geq Q_1;$$

and $Q_1 = a \times Q_3$, $Q_2 = b \times Q_1$, $Q_2 = c \times Q_3$;

wherein $0.1 \leq a \leq 150$, $1 \leq b \leq 2500$, $100 \leq c \leq 10000$:

wherein a calculation formula for $Q_1$ is $$Q_1 = \lambda_1 A \frac{T_1 - T_0}{b_1},$$

a calculation formula for $Q_2$ is $$Q_2 = \lambda_2 A \frac{T_2 - T_0}{b_2},$$

a calculation formula for $Q_3$ is $$Q_3 = \lambda_3 A \frac{T_3 - T_0}{b_3},$$

$$T_2 < T_{Minimum\ melting\ point\ of\ the\ covering\ layer};$$

$$T_2 < T_{Minimum\ melting\ point\ of\ the\ carrier};$$

$$T_0 \leq 25°\ C.;$$

wherein $Q_1$ represents a heat transfer rate of the covering layer; $Q_2$ represents a heat transfer rate of the thick film coating; $Q_3$ represents a heat transfer rate of the carrier;

$\lambda_1$ represents a heat conductivity coefficient of the covering layer; $\lambda_2$ represents a heat conductivity coefficient of the thick film coating; $\lambda_3$ represents a heat conductivity coefficient of the carrier;

A represents a contact area of the thick film coating with the covering layer or the carrier;

$b_1$ represents a thickness of the covering layer; $b_2$ represents a thickness of the thick film coating; $b_3$ represents a thickness of the carrier;

$T_0$ represents an initial temperature of the thick film element; $T_1$ represents a surface temperature of the covering layer; $T_2$ represents a heating temperature of the thick film coating; $T_3$ represents a surface temperature of the carrier;

$b_2 \leq 50$ μm; $b_3 \geq b_1$, $b_1 \leq 1$ mm, $b_3 \geq 1$ mm;

and $T_{Minimum\ melting\ point\ of\ carrier} > 25°$ C.

2. The thick film element according to claim 1, wherein the carrier and the thick film coating are bound by printing or sintering, the thick film coating and the covering layer are bound by printing or sintering.

3. The thick film element according to claim 2, wherein an area between the carrier and the covering layer without the thick film coating is bound by printing or sintering.

4. The thick film element according to claim 1, wherein the carrier comprises polyimides, organic insulating materials, inorganic insulating materials, ceramics, glass ceramics, quartz, crystal and stone materials.

5. The thick film element according to claim 1, wherein the thick film coating is one or more of silver, platinum, palladium, palladium oxide, gold and rare earth materials.

6. The thick film element according to claim 1, wherein the covering layer is made from one or more of polyester, polyimide or polyetherimide (PEI), ceramics, silica gel, asbestos, and micarex.

7. The thick film element according to claim 1, wherein an area of the thick film coating is smaller than or equal to an area of the covering layer or an area of the carrier.

8. A use of a thick film element for products with double-sided heating, wherein the thick film element with high heat conductivity on two sides thereof, comprising: a carrier; a thick film coating deposited on the carrier; and a covering layer overlaid on the coating, wherein the thick film coating is a heating material, and a mode of heating is electrical heating, wherein the carrier, the thick film coating and the covering layer are selected from a material that fulfills every of following equations:

$$Q_2 \geq Q_3;$$

$$Q_2 \geq Q_1;$$

and $Q_1 = a \times Q_3$, $Q_2 = b \times Q_1$, $Q_2 = c \times Q_3$;

wherein $0.1 \leq a \leq 150$, $1 \leq b \leq 2500$, $100 \leq c \leq 10000$;

wherein a calculation formula for $Q_1$ is $$Q_1 = \lambda_1 A \frac{T_1 - T_0}{b_1},$$

a calculation formula for $Q_2$ is $$Q_2 = \lambda_2 A \frac{T_2 - T_0}{b_2},$$

a calculation formula for $Q_3$ is $$Q_3 = \lambda_3 A \frac{T_3 - T_0}{b_3},$$

$$T_2 < T_{Minimum\ melting\ point\ of\ the\ covering\ layer};$$

$$T_2 < T_{Minimum\ melting\ point\ of\ the\ carrier};$$

$$T_0 \leq 25°\ C.;$$

wherein $Q_1$ represents a heat transfer rate of the covering layer; $Q_2$ represents a heat transfer rate of the thick film coating; $Q_3$ represents a heat transfer rate of the carrier;

$\lambda_1$ represents a heat conductivity coefficient of the covering layer; $\lambda_2$ represents a heat conductivity coefficient of the thick film coating; $\lambda_3$ represents a heat conductivity coefficient of the carrier;

A represents a contact area of the thick film coating with the covering layer or the carrier;

$b_1$ represents a thickness of the covering layer; $b_2$ represents a thickness of the thick film coating; $b_3$ represents a thickness of the carrier;

To represents an initial temperature of the thick film element; $T_1$ represents a surface temperature of the covering layer; $T_2$ represents a heating temperature of the thick film coating; $T_3$ represents a surface temperature of the carrier;

$b_2 \leq 50$ μm; $b_3 \geq b_1$, $b_1 \leq 1$ mm, $b_3 \geq 1$ mm;

and $T_{minimum\ melting\ point\ of\ the\ carrier} > 25°$ C.

9. The thick film element according to claim 8, wherein the carrier and the thick film coating are bound by printing or sintering, the thick film coating and the covering layer are bound by printing or sintering.

10. The thick film element according to claim 9, wherein an area between the carrier and the covering layer without the thick film coating is bound by printing or sintering.

11. The thick film element according to claim 8, wherein the carrier comprises polyimides, organic insulating materials, inorganic insulating materials, ceramics, glass ceramics, quartz, crystal and stone materials.

12. The thick film element according to claim 8, wherein the thick film coating is one or more of silver, platinum, palladium, palladium oxide, gold and rare earth materials.

13. The thick film element according to claim 8, wherein the covering layer is made from one or more of polyester, polyimide or polyetherimide (PEI), ceramics, silica gel, asbestos, and micarex.

14. The thick film element according to claim 8, wherein an area of the thick film coating is smaller than or equal to an area of the covering layer or an area of the carrier.

* * * * *